US009458649B2

(12) United States Patent
Fujiwara et al.

(10) Patent No.: US 9,458,649 B2
(45) Date of Patent: Oct. 4, 2016

(54) VEHICLE DOOR OPEN/CLOSE OPERATION APPARATUS

(71) Applicant: KABUSHIKI KAISHA HONDA LOCK, Miyazaki-shi, Miyazaki (JP)

(72) Inventors: Hiroto Fujiwara, Miyazaki (JP); Hiroyuki Kouzuma, Miyazaki (JP); Kazuyuki Kuriyama, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 73 days.

(21) Appl. No.: 14/373,943

(22) PCT Filed: Jan. 9, 2013

(86) PCT No.: PCT/JP2013/050219
§ 371 (c)(1),
(2) Date: Jul. 23, 2014

(87) PCT Pub. No.: WO2013/111615
PCT Pub. Date: Aug. 1, 2013

(65) Prior Publication Data

US 2015/0013403 A1 Jan. 15, 2015

(30) Foreign Application Priority Data

Jan. 24, 2012 (JP) ..... 2012-012386

(51) Int. Cl.
*E05B 81/56* (2014.01)
*E05B 39/00* (2006.01)
(Continued)

(52) U.S. Cl.
CPC ..... *E05B 81/56* (2013.01); *E05B 39/00* (2013.01); *E05B 47/0001* (2013.01);
(Continued)

(58) Field of Classification Search
CPC ..... E05B 81/56; E05B 39/00; E05B 47/00; G02B 6/00; B60R 25/10
USPC ..... 340/5.61, 426.16, 426.17, 5.31, 5.3, 340/5.54; 200/61.62; 385/13
See application file for complete search history.

(56) References Cited

U.S. PATENT DOCUMENTS 5,844,470 A * 12/1998 Garnault ..... E05B 81/20 180/287
7,173,346 B2 * 2/2007 Aiyama ..... B60R 21/0136 307/10.1

(Continued)

FOREIGN PATENT DOCUMENTS

CN 1540121 A 10/2004
CN 101018921 A 8/2007

(Continued)

OTHER PUBLICATIONS

Official Communication dated Sep. 6, 2015 corresponding to Chinese Patent Application No. 201380006509.0.

(Continued)

*Primary Examiner* — Nam V Nguyen
(74) *Attorney, Agent, or Firm* — Carrier Blackman & Associates, P.C.; Joseph P. Carrier; William D. Blackman

(57) ABSTRACT

A vehicle door open/close operation apparatus is provided in which a design cover can be opened by a manual operation and can close at least part of an opening provided in a door, and a latch release is operated by a latch device due to the operation of an operating member in a state in which the design cover is open, wherein displacement of the design cover from a closed position toward an open position is detected by a detection switch, and a control unit carries out the user authentication in response to detection of displacement of the design cover by the detection switch. This enables the necessity for carrying out an operation of the operating member again to be avoided even if the operating member is operated quickly, thus enabling the door to be opened smoothly.

3 Claims, 15 Drawing Sheets

(51) Int. Cl.

| | |
|---|---|
| ***G02B 6/00*** | (2006.01) |
| ***H04B 1/00*** | (2006.01) |
| ***B60J 5/04*** | (2006.01) |
| ***E05B 81/78*** | (2014.01) |
| ***E05B 85/10*** | (2014.01) |
| ***E05B 47/00*** | (2006.01) |
| *E05B 85/18* | (2014.01) |
| *E05B 81/14* | (2014.01) |
| *E05B 81/16* | (2014.01) |
| *E05B 81/90* | (2014.01) |

(52) U.S. Cl.

CPC ..... *E05B 81/77* (2013.01); *E05B 81/78* (2013.01); *E05B 85/103* (2013.01); *E05B 81/14* (2013.01); *E05B 81/16* (2013.01); *E05B 81/90* (2013.01); *E05B 85/18* (2013.01); *Y10T 70/625* (2015.04); *Y10T 70/7102* (2015.04)

(56) References Cited

U.S. PATENT DOCUMENTS

| | | | | |
|---|---|---|---|---|
| 7,283,034 | B2 * | 10/2007 | Nakamura | B60R 25/246 340/5.2 |
| 7,375,299 | B1 * | 5/2008 | Pudney | H01H 9/06 200/61.62 |
| 7,543,863 | B2 * | 6/2009 | Herbert | E05B 85/107 292/336.3 |
| 7,598,469 | B2 | 10/2009 | Tanimoto et al. | |
| 7,938,460 | B2 * | 5/2011 | Ishiguro | E05B 81/76 200/302.1 |
| 8,044,768 | B2 * | 10/2011 | Nakasato | B60R 25/2027 340/426.16 |
| 8,443,553 | B1 * | 5/2013 | Polewarczyk | E05B 81/77 16/412 |
| 9,062,478 | B2 * | 6/2015 | Bingle | E05B 81/28 |
| 9,080,352 | B2 * | 7/2015 | Aerts | E05B 85/103 |
| 2008/0250607 | A1 * | 10/2008 | Ito | E05B 81/78 16/412 |
| 2009/0039671 | A1 * | 2/2009 | Thomas | E05B 81/76 296/146.1 |

FOREIGN PATENT DOCUMENTS

| | | | |
|---|---|---|---|
| DE | 102005049884 | A1 | 4/2007 |
| DE | 102006060540 | A1 | 6/2008 |
| DE | 202011104328 | U1 | 9/2011 |
| EP | 1793069 | A1 | 6/2007 |
| EP | 1932984 | A2 | 6/2008 |
| JP | S59-102765 | U | 7/1984 |
| JP | H11172983 | A | 6/1999 |
| JP | 2007297812 | A | 11/2007 |
| JP | 2008-057199 | A | 3/2008 |
| JP | 2009-228251 | A | 10/2009 |

OTHER PUBLICATIONS

Official Communication dated May 6, 2016 for corresponding European Application No. 13741156.

* cited by examiner

VEHICLE DOOR OPEN/CLOSE OPERATION APPARATUS

TECHNICAL FIELD

The present invention relates to a vehicle door open/close operation apparatus that includes a design cover that can be opened by a manual operation and that can close at least part of an opening provided in a door, an operating member that can be manually operated in a state in which the design cover is open, a latch device that can switch between an unlocked state in which latch release of the door is enabled and a locked state in which latch release of the door is disabled and that has an electric actuator for latch release for releasing the latched state of the door in response to an operation in the unlocked state, and a control unit that can carry out user authentication for confirming whether or not a person operating the operating member is a legitimate vehicle user and that controls operation of the electric actuator for latch release so as to operate the electric actuator for latch release so as to release the latched state in response to operation of the operating member in a state in which being a legitimate vehicle user has been authenticated.

BACKGROUND ART

A vehicle door open operation apparatus in which a flap (design cover) covering an opening provided in a door panel is axially supported on a case mounted on the door panel so that the flap can be pushed in by means of the back of a finger of a vehicle user, and a handle lever (operating member) is housed within the opening so that the handle lever can be operated by being pushed up by means of the tip of the finger when the flap is open is known from Patent Document 1.

On the other hand, in a recent smart entry system, there is an arrangement in which user authentication is carried out when a detection switch detects a slight pulling operation of a door handle when a user is getting into a vehicle, in a state in which the legitimacy of the vehicle user has been authenticated a latch device is switched from a locked state to an unlocked state, and the latched state of the latch device is released by further pulling the door handle; the technique disclosed in Patent Document 1 above can be applied to a smart entry system with the door handle as the operating member.

RELATED ART DOCUMENTS

Patent Document

Patent Document 1: Japanese Utility Model Application Laid-open No. 59-102765

SUMMARY OF THE INVENTION

Problems to be Solved by the Invention

However, in a smart entry system to which the technique disclosed in Patent Document 1 above is simply applied, a small amount of operation of the operating member in a state in which the design cover is open is detected by means of the detection switch and user authentication is carried out, and in a state in which the legitimacy of the vehicle user has been authenticated the latch device is switched from a locked state to an unlocked state. Because of this, when the speed of operation of the operating member is high, there is a possibility that the latch release operation will start in the latch device before the latch device is switched from a locked state to an unlocked state after completion of authentication of the vehicle user; in this case the door cannot be opened, and it is necessary to carry out operation of the operating member again.

The present invention has been accomplished in light of such circumstances, and it is an object thereof to provide a vehicle door open/close operation apparatus in which, while a latch release operation is carried out in a latch device by means of the operation of an operating member in a state in which a design cover is opened, the necessity for carrying out an operation of the operating member again can be avoided even if the operating member is operated quickly, thus enabling the door to be opened smoothly.

Means for Solving the Problems

In order to attain the above object, according to a first aspect of the present invention, there is provided a vehicle door open/close operation apparatus comprising a design cover that can be opened by a manual operation and that can close at least part of an opening provided in a door, an operating member that can be manually operated in a state in which the design cover is open, a latch device that can switch between an unlocked state in which latch release of the door is enabled and a locked state in which latch release of the door is disabled and that has an electric actuator for latch release for releasing the latched state of the door in response to an operation in the unlocked state, and a control unit that can carry out user authentication for confirming whether or not a person operating the operating member is a legitimate vehicle user and that controls operation of the electric actuator for latch release so as to operate the electric actuator for latch release so as to release the latched state in response to operation of the operating member in a state in which being a legitimate vehicle user has been authenticated, characterized in that the apparatus comprises a detection switch for detecting displacement of the design cover from a closed position toward an open position, and the control unit carries out the user authentication in response to detection of displacement of the design cover by the detection switch.

Further, according to a second aspect of the present invention, in addition to the first aspect, the latch device comprises an electric actuator for lock/unlock switching that can switch between the unlocked state and the locked state, and the control unit controlling operation of the electric actuator for lock/unlock switching operates the electric actuator for lock/unlock switching so as to switch the latch device from the locked state to the unlocked state in response to the detection switch detecting displacement of the design cover from the closed position toward the open position.

According to a third aspect of the present invention, in addition to the second aspect, the control unit operates the electric actuator for lock/unlock switching so as to switch the latch device from the unlocked state to the locked state in response to the detection switch detecting a displacement of the design cover from the closed position toward the open position in a state in which the latch device is unlocked.

A first detection switch 26 of an embodiment corresponds to the detection switch of the present invention, an electric motor 56 for lock/unlock switching of the embodiment corresponds to the electric actuator for lock/unlock switching of the present invention, and an electric motor 57 for latch release of the embodiment corresponds to the electric actuator for latch release of the present invention.

Effects of the Invention

In accordance with the first aspect of the present invention, since the control unit carries out user authentication at the timing of detecting displacement of the design cover from the closed position toward the open position by means of the detection switch, it is possible to complete user authentication before operation of the operating member starts, and even if the speed of operation of the operating member is high it is possible to avoid the necessity for operating the operating member again, thus enabling the door to be opened smoothly.

Furthermore, in accordance with the second aspect of the present invention, since the electric actuator for lock/unlock switching of the latch device switches the latch device from the locked state to the unlocked state in response to the detection switch detecting a displacement of the design cover from the closed position toward the open position it is possible, in addition to carrying out user authentication, to switch the latch device to the unlocked state prior to operation of the operating member, thereby making opening of the door more smooth.

Moreover, in accordance with the third aspect of the present invention, when the detection switch has detected a displacement of the design cover from the closed position toward the open position when the latch device is in the unlocked state, since the electric actuator for lock/unlock switching switches the latch device from the unlocked state to the locked state, it is not necessary to provide, separately from the detection switch, a lock switch for confirming the intention of a vehicle user to close the door, thus enabling the overall size of the apparatus to be reduced.

EXPLANATION OF REFERENCE NUMERALS AND SYMBOLS

Figure 1:
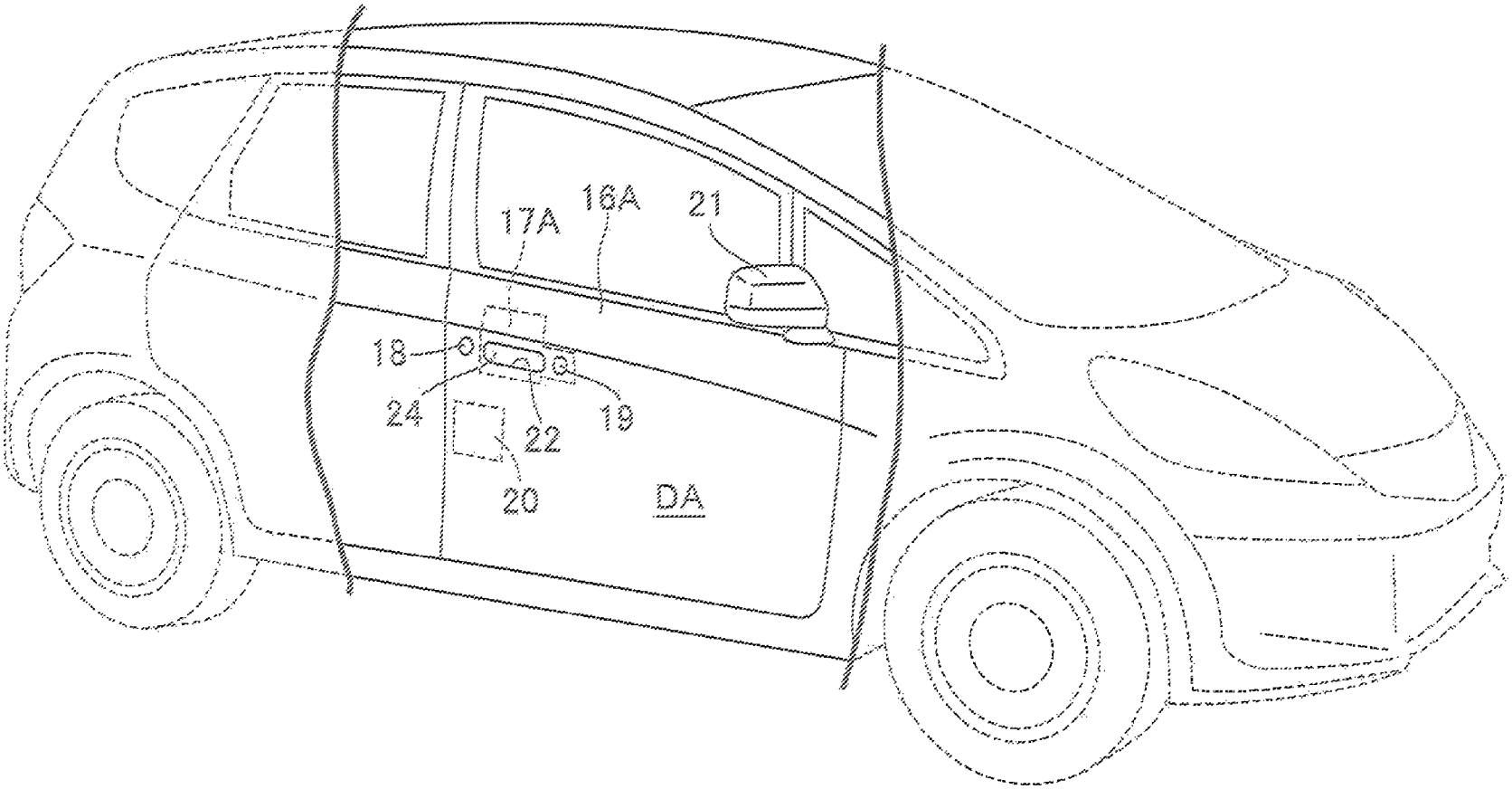
FIG. 1 is a perspective view of a passenger vehicle of a first embodiment. (first embodiment)

20 Latch device
22, 72, 92 Opening
24, 74, 94 Design cover
25, 75, 95 Operating member
26 First detection switch, which is a detection switch
56 Electric motor for lock/unlock switching, which is an electric actuator for lock/unlock switching
57 Electric motor for latch release, which is an electric actuator for latch release
58 Control unit
DA, DB, DC Front side door, which is a door

MODES FOR CARRYING OUT THE INVENTION

Modes for carrying out the present invention are explained below by reference to the attached drawings.

First Embodiment

A first embodiment of the present invention is explained by reference to FIG. 1 to FIG. 9; first, in FIG. 1, a door of this passenger vehicle, for example, a front side door DA, has disposed on its outer panel 16A latch release operation means 17A, a cylinder lock 18, and a lock switch 19. Also disposed on the front side door DA are a door mirror 21 and a latch device 20 that is switchable between a latched state in which a closed state of the front side door DA is maintained and an unlatched state in which the front side door DA can be opened.

Figure 2:
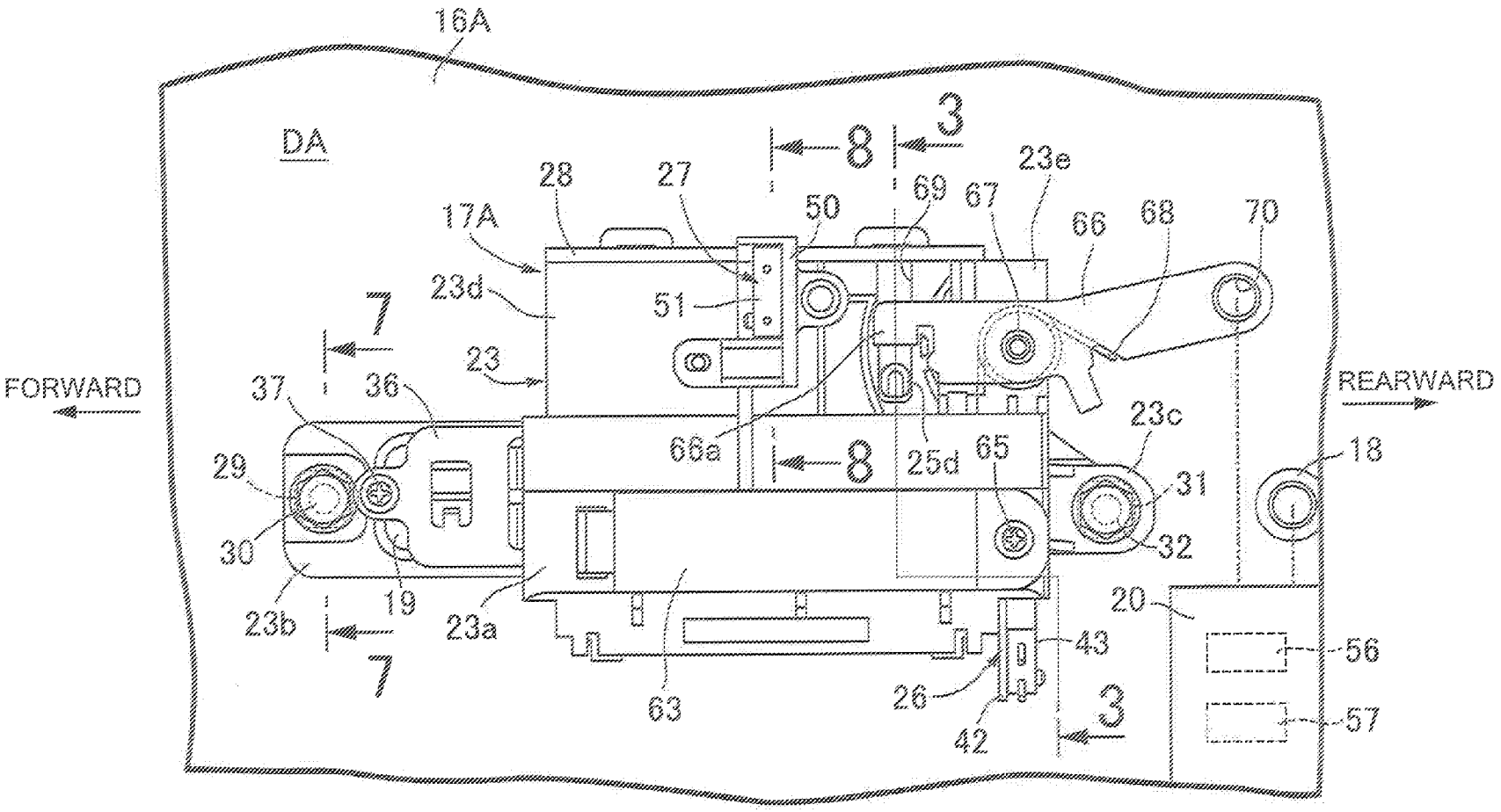
FIG. 2 is a view of latch release operation means when viewed from the inner side of an outer panel. (first embodiment)
Figure 3:
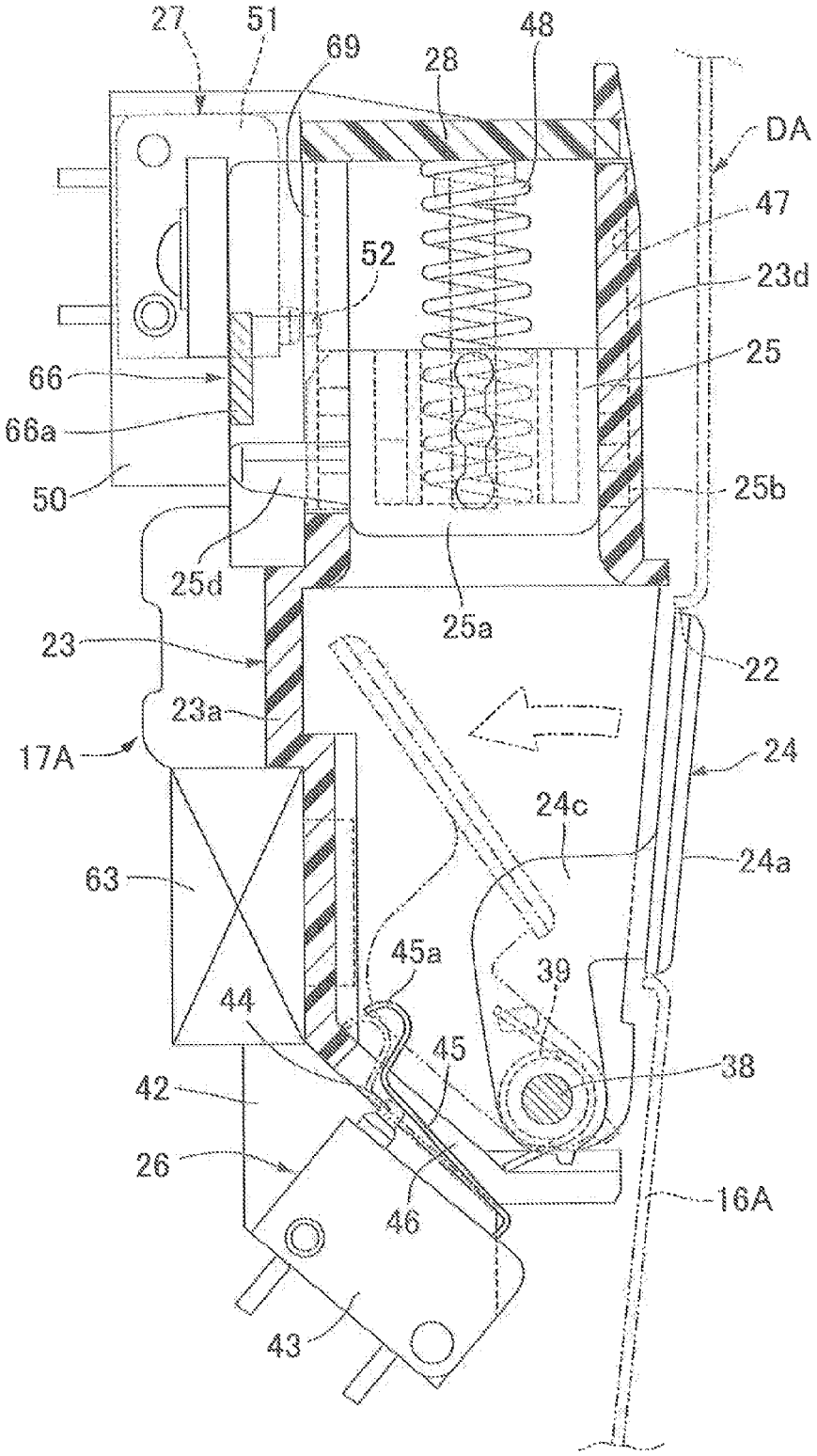
FIG. 3 is an enlarged sectional view along line 3-3 in FIG. 2. (first embodiment)

Referring in addition to FIG. 2 and FIG. 3, provided on the outer panel 16A of the front side door DA is a rectangular opening 22 that is long in the fore-and-aft direction, and mounted on the outer panel 16A at a position corresponding to the opening 22 is the latch release operation means 17A such that it can be operated with a hand inserted into the opening 22 from the outside.

Figure 4:
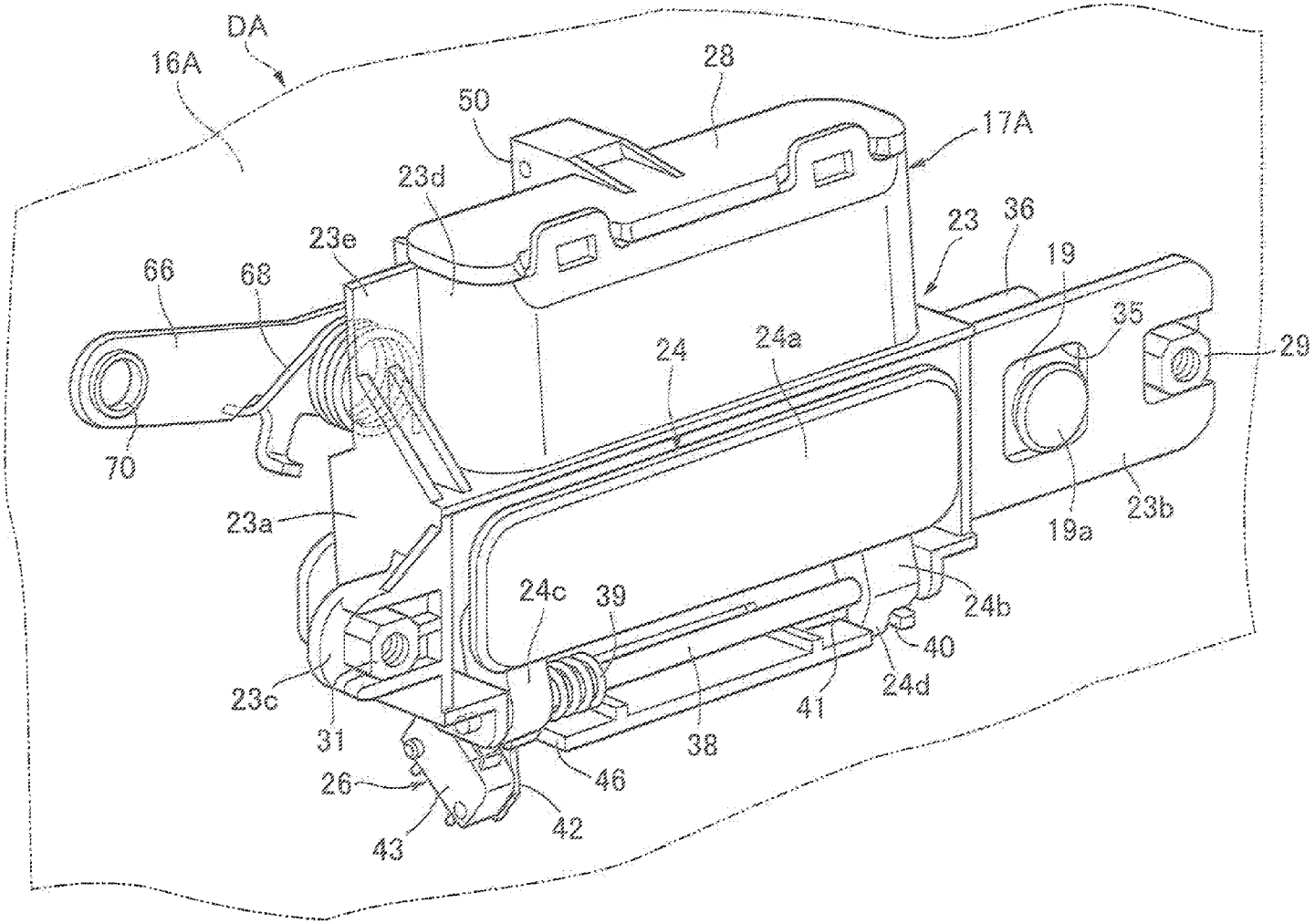
FIG. 4 is a perspective view of the latch release operation means when viewed obliquely from the rear from the outer side. (first embodiment)
Figure 5:
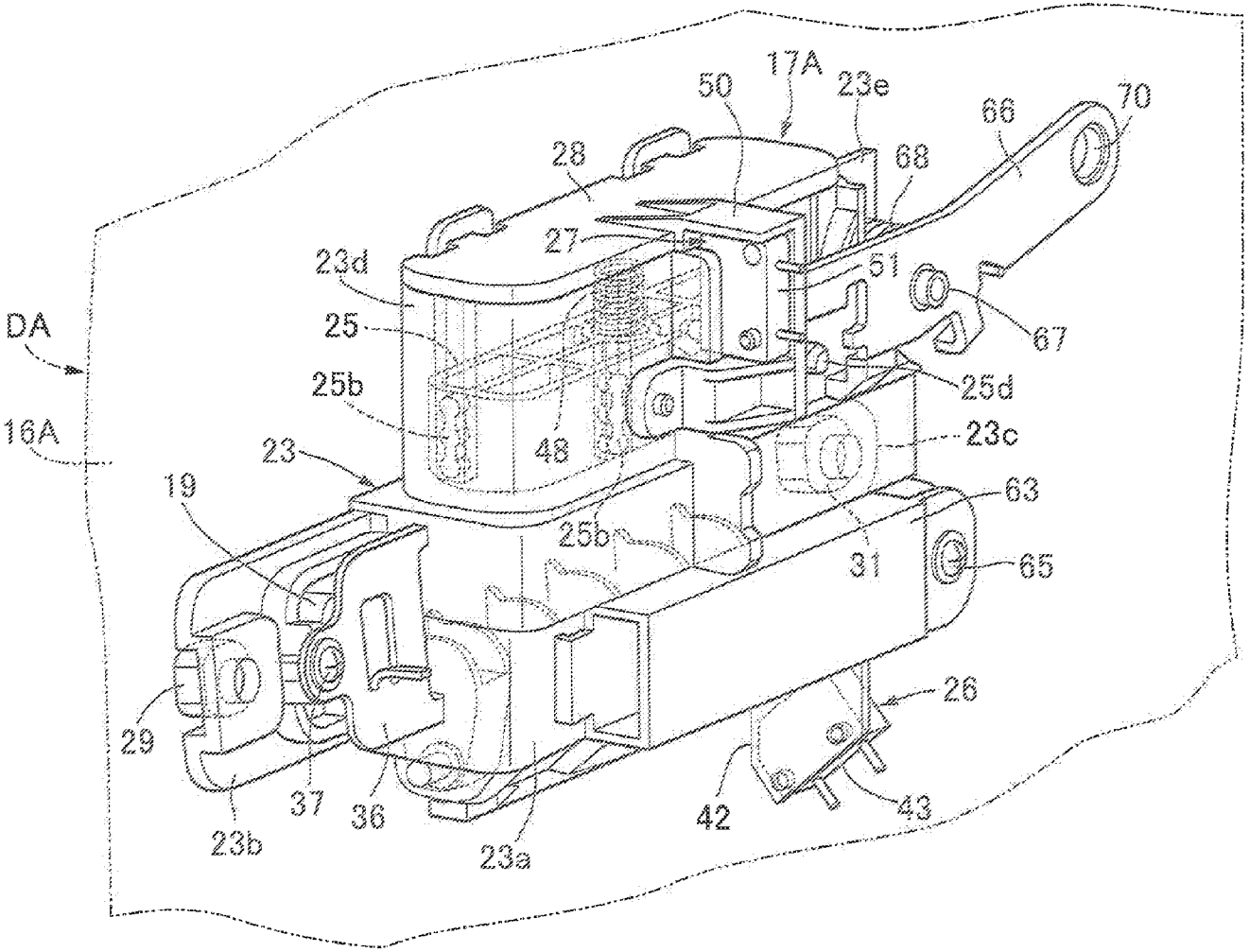
FIG. 5 is a perspective view of the latch release operation means when viewed obliquely from the front from the inner side. (first embodiment)
Figure 6:
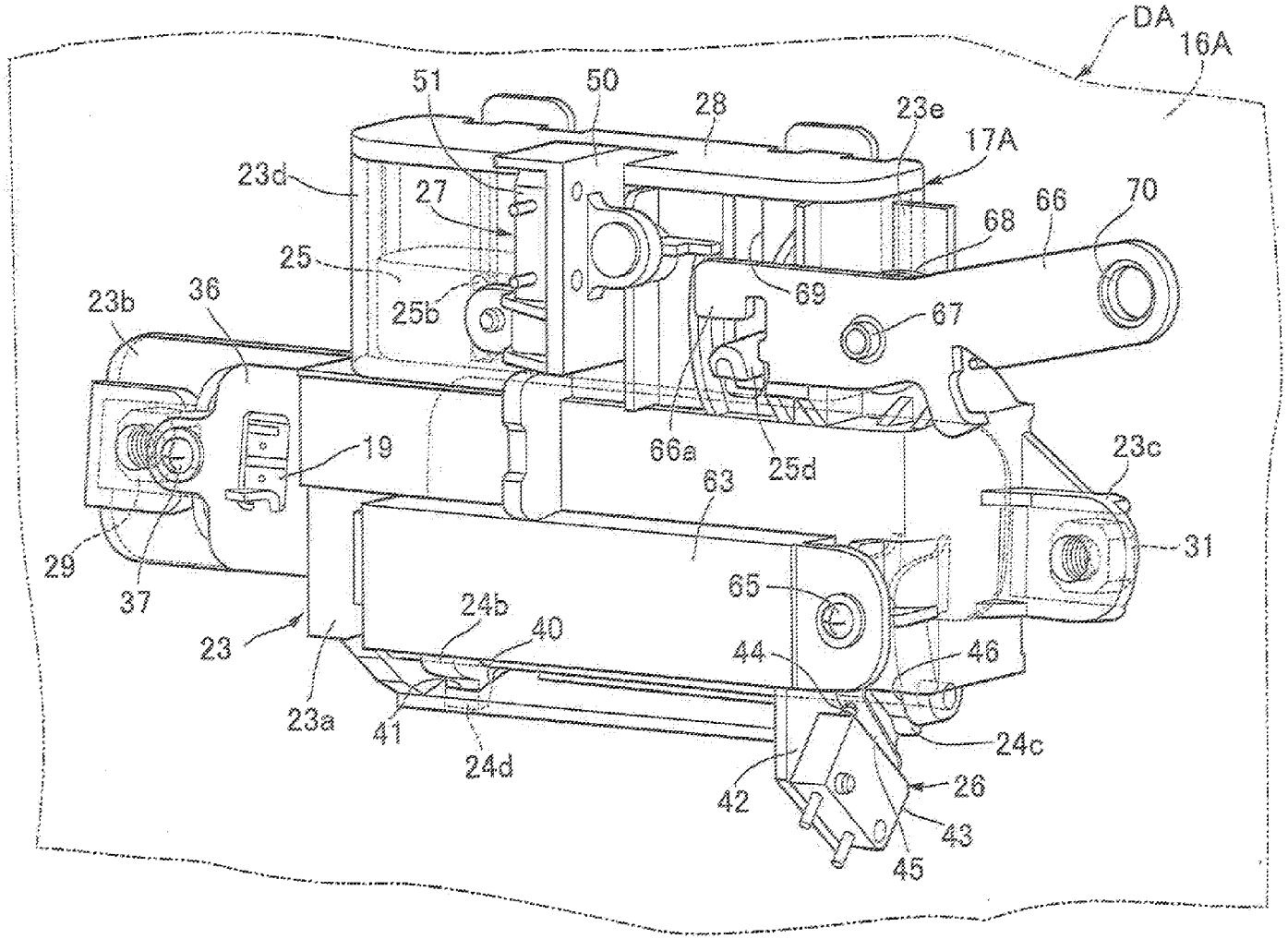
FIG. 6 is a perspective view of the latch release operation means when viewed obliquely from the rear from the inner side. (first embodiment)

Referring in addition to FIG. 4 to FIG. 6, the latch release operation means 17A includes a case 23 that is mounted on an inner face of the outer panel 16A, a design cover 24 that is supported on the case 23 so as to close at least part (the entirety in this embodiment) of the opening 22 and be opened by a manual operation, an operating member 25 that is supported on the case 23 so as to be manually operated in a state in which the design cover 24 is open, a first detection switch 26 that is mounted on the case 23 so as to detect a displacement of the design cover 24 from a closed position toward an open position, and a second detection switch 27 that is mounted on the case 23 so as to detect an operation of the operating member 25.

The case 23 is formed so as to integrally have a box-shaped portion 23*a* that is formed into a box shape opening toward the opening 22, a front mounting plate portion 23*b* that extends forwardly from the front end of the box-shaped portion 23*a*, a rear mounting plate portion 23*c* that extends rearwardly from the rear end of the box-shaped portion 23*a*, and a tubular portion 23*d* that extends upwardly from the upper end of the box-shaped portion 23*a*. Fixed to an upper end part of the tubular portion 23*d* is a lid member 28 so as to close an opening at the upper end of the tubular portion 23*d*.

Figure 7:
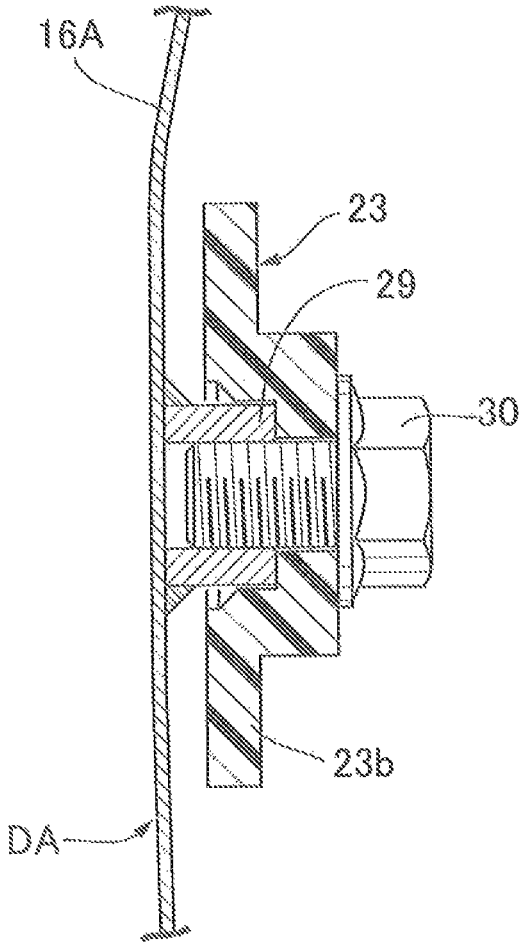
FIG. 7 is an enlarged sectional view along line 7-7 in FIG. 2. (first embodiment)

As shown in FIG. 7, a nut 29 is secured by welding to an inner face of the outer panel 16A at a position corresponding to the front mounting plate portion 23*b*, and a bolt 30 inserted through the front mounting plate portion 23*b* is screwed into the nut 29. Furthermore, a nut 31 is secured by welding to the inner face of the outer panel 16A at a position corresponding to the rear mounting plate portion 23*c*, and a bolt 32 inserted through the rear mounting plate portion 23*c* is screwed into the nut 31. In this way, the case is fixedly mounted on the inner face of the outer panel 16A by screwing and tightening the bolts 30 and 32 into the nuts 29 and 31.

Provided in the front mounting plate portion 23*b* is a rectangular through hole 35 (see FIG. 4) positioned between the bolt 30 and nut 29 and the box-shaped portion 23*a*. On the other hand, the lock switch 19 disposed on the inner side of the front mounting plate portion 23*b* while making an operating button 19*a* face the through hole 35 is supported on a switch support plate 36, a rear end part of the switch support plate 36 is engaged with a front end part of the box-shaped portion 23*a*, and a front end part of the switch support plate 36 is secured to the front mounting plate portion 23*b* by means of a screw member 37.

The design cover 24 integrally has a flat plate-shaped cover portion 24*a* that is formed into a shape corresponding to the opening 22 so that it can close the entire opening 22, a leg portion 24*b* that extends downwardly from a front part of the cover portion 24*a*, and a leg portion 24*c* that extends downwardly from a rear part of the cover portion 24*a*, lower parts of the two leg portions 24*b* and 24*c* being pivotably supported on a lower part of the box-shaped portion 23*a* via a support shaft 38 inserted through the leg portions 24*b* and 24*c*, and the design cover 24 being pivotable between a closed position (a position denoted by the solid line in FIG. 3) and an open position (a position denoted by the broken line in FIG. 3).

Moreover, provided between the design cover 24 and the box-shaped portion 23*a* is a first return spring 39, which is a torsion spring surrounding the support shaft 38, the design cover 24 being urged toward the closed position by means of the first return spring 39. Furthermore, a restricting projecting portion 24*d* extending through a lower side wall of the box-shaped portion 23*a* and extending downwardly is integrally provided with one of the two leg portions 24*b* and 24*c* of the design cover 24, in this embodiment the leg portion 24*b* extending downwardly from the front part of the cover portion 24*a*. On the other hand, provided in a front lower side wall of the box-shaped portion 23*a* is a first slit 40 allowing movement of the restricting projecting portion 24*d* when pivoting the design cover 24 between the closed position and the open position, an inner end part of the first slit 40 being closed by a first stopper 41, and when the design cover 24 is in the closed position, the restricting projecting portion 24*d* abutting against the first stopper 41 so as to restrict the end of pivoting of the design cover 24 toward the closed position.

A first stay 42 extending downwardly is integrally provided with a lower part at the inner end of the rear part of the box-shaped portion 23*a* of the case 23, and the first detection switch 26 is mounted on the first stay 42 so as to detect that the design cover 24 has pivoted from the closed position toward the open position. Thus, the first detection switch 26 has a switch case 43 secured to the first stay 42, a detector 44 protruding from the switch case 43, and a plate spring 45 having one end part supported on the switch case 43.

Furthermore, provided in a lower part of the box-shaped portion 23*a* in a portion corresponding to the leg portion 24*c* of the design cover 24 is a second slit 46 extending in parallel to the first slit 40, in a state in which the switch case 43 is secured to the first stay 42 the tip of the detector 44 projecting into a lower part within the box-shaped portion 23*a*. Moreover, the other end part of the plate spring 45 having said one end part supported on the switch case 43 projects into the box-shaped portion 23*a* through the second slit 46, a contact portion 45*a* is formed on the other end part of the plate spring 45, the contact portion 45*a* being rounded into an arc shape so as to be in contact with the leg portion 24*c* of the design cover 24, and an intermediate part, close to the contact portion 45*a*, of the plate spring 45 is in contact with the detector 44. The plate spring 45 exhibits a resilient force that relaxes the contact pressure with the detector 44, and when the design cover 24 pivots from the closed position toward the open position and the leg portion 24*c* abuts against the contact portion 45*a* of the plate spring 45, the detector 44 is pushed in by means of the plate spring 45, thereby turning the first detection switch 26 ON.

The operating member 25 has an outer shape corresponding to the inner shape of the tubular portion 23*d* of the case 23, is formed into a bottomed tubular shape that is open at one end and closed at the other end with an end wall portion 25*a*, and is slidably fitted into the tubular portion 23*d* with the end wall portion 25*a* at a lower position.

Figure 8:
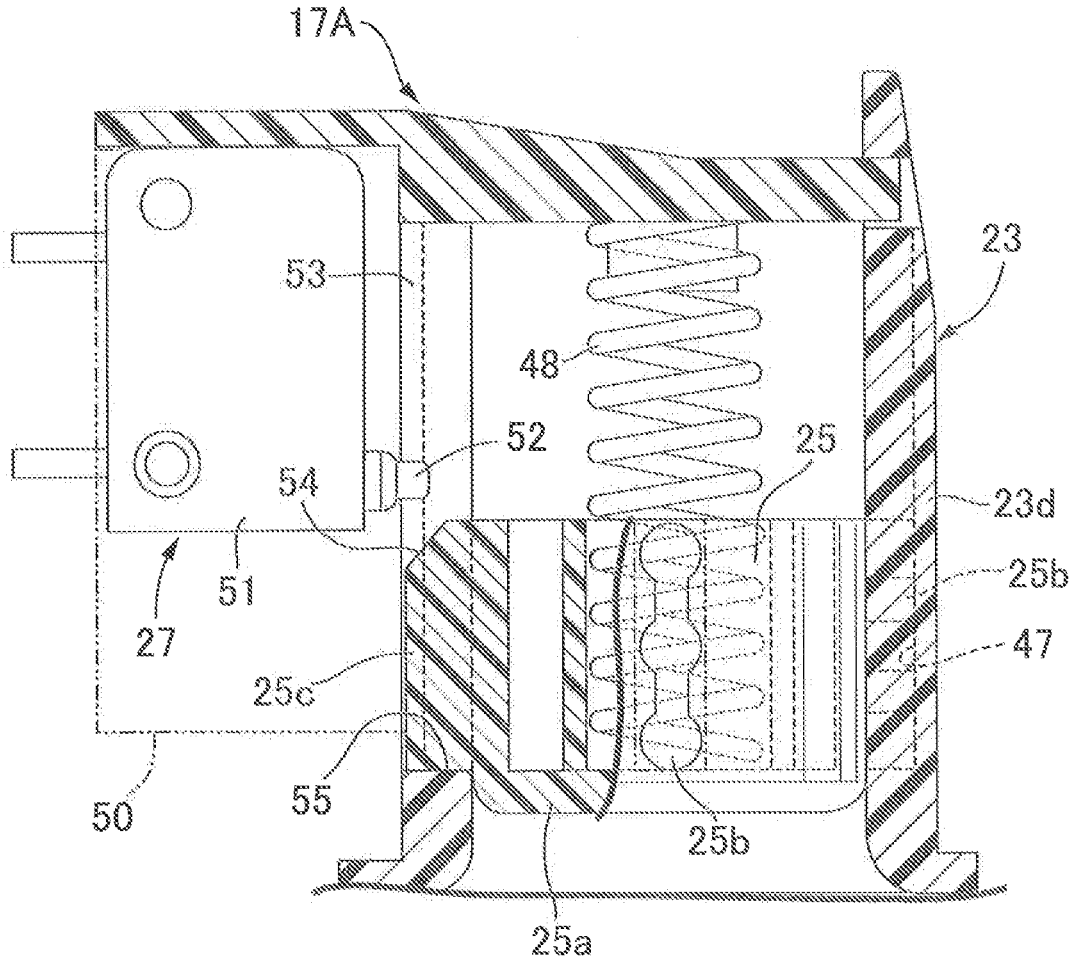
FIG. 8 is an enlarged sectional view along line 8-8 in FIG. 2. (first embodiment)

Referring in addition to FIG. 8, guide projecting portions 25*b* extending in the vertical direction are provided at a plurality of locations in the peripheral direction of the operating member, and the guide projecting portions 25*b* are fitted into a plurality of guide grooves 47 provided on an inner face of the tubular portion 23*d* and extending in the vertical direction. The operating member 25 is thus movable in the vertical direction within the tubular portion 23*d* such that each of the guide projecting portions 25*b* is guided by the respective guide groove 47.

A second return spring 48, which is a coil spring, is provided in a compressed state between the operating member 25 and the lid member 28 for closing the opening at the upper end of the tubular portion 23*d*, and the operating member 25 is urged downwardly toward a non-operated position shown in FIG. 3 and FIG. 8 by virtue of the spring force exhibited by the second return spring 48.

A second stay 50 is integrally provided with the lid member 28, the second stay 50 extending downwardly at a position in which the tubular portion 23*d* is sandwiched between the second stay 50 and the outer panel 16A, and the second detection switch 27 being secured to the second stay 50.

The second detection switch 27 has a switch case 51 secured to the second stay 50, and a detector 52 protruding from the switch case 51. On the other hand, the tubular portion 23*d* is provided with a third slit 53 extending vertically, the tip of the detector 52 facing the third slit 53 in a state in which the switch case 51 is secured to the second stay 50, a detection projecting portion 25*c* fitted within the third slit 53 is projectingly provided integrally with the operating member 25, and a detection face 54 abutting against the tip of the detector 52 so as to push the detector 52 toward the switch case 51 is formed on the detection projecting portion 25*c* so as to be inclined downwardly in going away from an outside face of the operating member 25.

When the operating member 25 in the non-operated position moves slightly toward the operated position, the second detection switch 27 is turned ON due to the detector 52 being pushed in by means of the detection face 54.

Furthermore, a second stopper 55 defining the lower end of the third slit 53 is provided in the tubular portion 23*d*, and the end of movement of the operating member 25 toward the non-operated position is restricted by the detection projecting portion 25*c* abutting against the second stopper 55.

Figure 9:
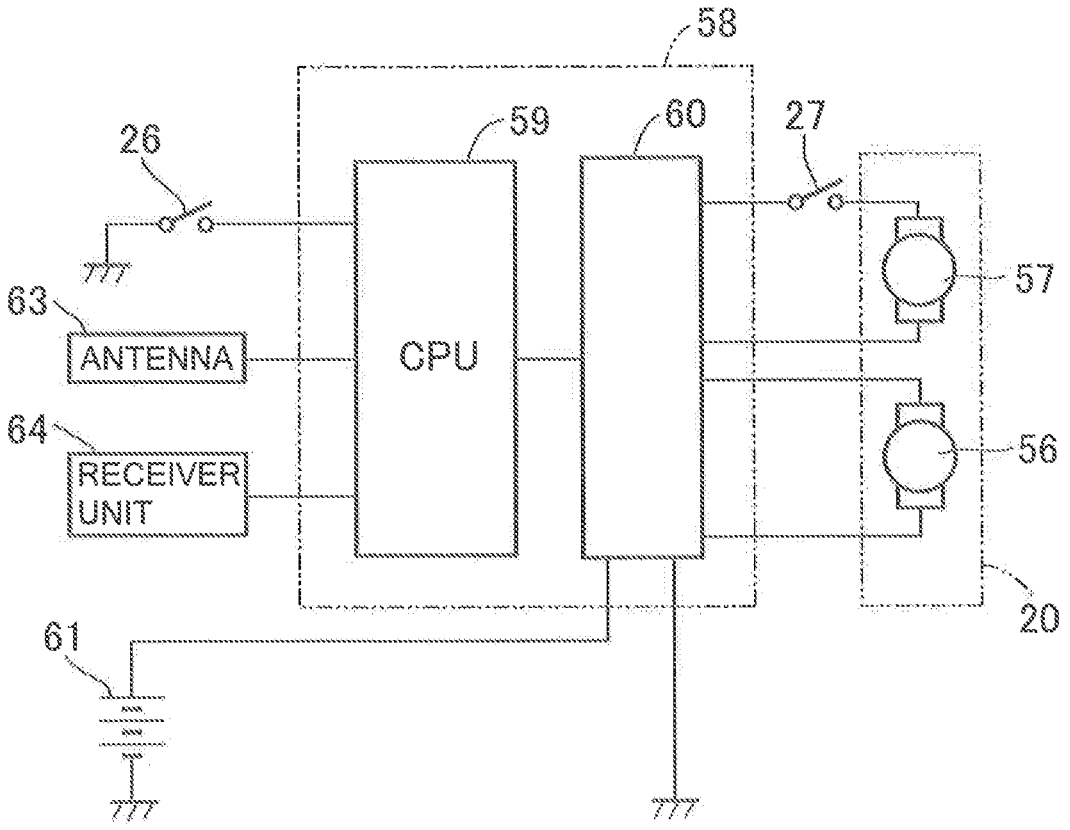
FIG. 9 is a view showing the arrangement of a control system. (first embodiment)

Referring in addition to FIG. 9, the latch device 20 has an electric motor for lock/unlock switching 56, which is an electric actuator for lock/unlock switching that can switch over between an unlocked state in which latch release of the front side door DA is enabled and a locked state in which latch release of the front side door DA is disabled, and an electric motor for latch release 57, which is an electric actuator for latch release that releases the latched state of the front side door DA in response to an operation in the unlocked state.

Operations of the electric motor for lock/unlock switching 56 and the electric motor for latch release 57 are controlled by means of a control unit 58 disposed within the front side door DA, the control unit 58 having a CPU 59 and a power supply control circuit 60, and a battery 61 being connected to the CPU 59 and the power supply control circuit 60.

Inputted into the CPU 59 are signals from an antenna 63 and a receiver unit 64 used for transfer of an ID signal between the first detection switch 26 and a portable apparatus carried by a legitimate vehicle user. The antenna 63 is secured to a back face of the box-shaped portion 23*a* of the case 23 by means of a screw member 65.

The power supply control circuit 60 is connected to the motor for latch release 57 via the second detection switch 27 and also connected to the electric motor for lock/unlock switching 56.

The CPU 59 carries out user authentication in order to confirm whether or not a person operating the design cover 24 is a legitimate vehicle user in response to the first detection switch 26 detecting that the design cover 24 has been operated from the closed position toward the open position. After being a legitimate vehicle user has been authenticated, the CPU 59 controls the power supply control circuit 56 so that electric power for operating the electric motor for lock/unlock switching 56 so as to switch the latch device 20 from a locked state to an unlocked state is supplied to the electric motor for lock/unlock switching 56, and controls the power supply control circuit 60 so that electric power for operating the motor for latch release 57 in an unlocked state can be outputted, and in response to the second detection switch 27 being turned ON by detecting a vehicle user operating it from the non-operated position slightly toward the operated position, electric power is supplied from the power supply control circuit 60 to the motor for latch release 57.

That is, the control unit 58 carries out user authentication in response to the first detection switch 26 detecting displacement of the design cover 24 from the closed position toward the open position and, after confirming that it is a legitimate vehicle user, operates the electric motor for lock/unlock switching 56 so as to switch the latch device 20 from the locked state to the unlocked state.

When the operation of the electric motor for lock/unlock switching 56 and of the electric motor for latch release 57 becomes disabled due to the battery 61 becoming flat, etc., the latch device 20 can switch from the locked state to the unlocked state in response to a mechanical operating force transmitted from the cylinder lock 18 in response to the cylinder lock 18 being operated by means of a mechanical key, and in this state the latch device 20 attains a latch release state in response to a mechanical operating force being transmitted to the latch device 20 from a lever 66 operating in response to the design cover 24 being opened and the operating member 25 being pushed up from the non-operated position to the operated position.

The lever 66 is disposed so as to extend in the fore-and-aft direction at a position in which a rear part of the tubular portion 23*d* of the case 23 is sandwiched between the lever 66 and the outer panel 16A of the front side door DA, and a longitudinally intermediate part of the lever 66 is pivotably supported, via a pin 67, on a support plate 23*e* provided in a rear end part of the tubular portion 23*d* and protruding rearwardly.

A pressure-receiving portion 66*a* facing downwardly is provided in a front end part of this lever 66. On the other hand, a guide hole 69 is provided in the tubular portion 23*d*, the guide hole 69 extending vertically at a position corresponding to the front end part of the lever 66, and a pressing projecting portion 25*d* projectingly provided integrally with the operating member 25 and opposing the pressure-receiving portion 66*a* from below is inserted through the guide hole 69. Furthermore, a third return spring 68 is provided between the lever 66 and the case 23, the third return spring 68 being a torsion spring surrounding the pin 67, and the lever 66 being urged, by virtue of a spring force exhibited by the third return spring 68, toward the side on which the pressure-receiving portion 66*a* moves closer to the pressing projecting portion 25*d*.

When the operating member 25 is operated from the non-operated position toward the operated position, the spring force of the third return spring 68 acts on the operating member 25 in addition to the spring force of the second return spring 48, and it becomes necessary to push up the operating member 25 against the spring forces of the second and third return springs 48 and 68.

A linking hole 70 is provided in a rear end part of the lever 66, and one end part of a rod, etc. for transmitting a mechanical operating force from the lever 66 to the latch device 20 is linked to the linking hole 70.

The operation of this first embodiment is now explained; the opening 22 is provided in the outer panel 16A of the front side door DA, the opening 22 is closed by the design cover 24, which can be opened in response to a manual operation, and the control unit 58 for controlling the electric motor for latch release 57 of the latch device 20, which can switch between an unlocked state in which latch release of the front side door DA is enabled and a locked state in which latch release of the front side door DA is disabled, can carry out user authentication for confirming whether or not a person operating the operating member 25, which can be manually operated while the design cover 24 is open, is a legitimate vehicle user and can operate the electric motor for latch release 57 so that the latched state is released in response to operation of the operating member 25 in a state in which being a legitimate vehicle user has been authenticated; when displacement of the design cover 24 from the closed position toward the open position is detected by the first detection switch 26, the control unit 58 carries out user authentication, user authentication can be completed before operation of the operating member 25 starts, and even if the speed of operation of the operating member 25 is high, it is possible to avoid the necessity for operating the operating member 25 again and to open the front side door DA smoothly.

Furthermore, since the latch device 20 includes the electric motor for lock/unlock switching 56 for switching between the unlocked state and the locked state, and the control unit 58 for controlling operation of the electric motor for lock/unlock switching 56 operates the electric motor for lock/unlock switching 56 so as to switch the latch device 20 from the locked state to the unlocked state in response to the first detection switch 26 detecting displacement of the design cover 24 from the closed position toward the open position, it is possible to switch the latch device 20 to the unlocked state subsequent to user authentication but before operation of the operating member 25, and to make opening of the front side door DA more smooth.

Second Embodiment

A second embodiment of the present invention is explained by reference to FIG. 10 to FIG. 13; parts corresponding to those of the first embodiment are illustrated with the same reference numerals and numbers, and detailed explanation thereof is omitted.

Figure 10:
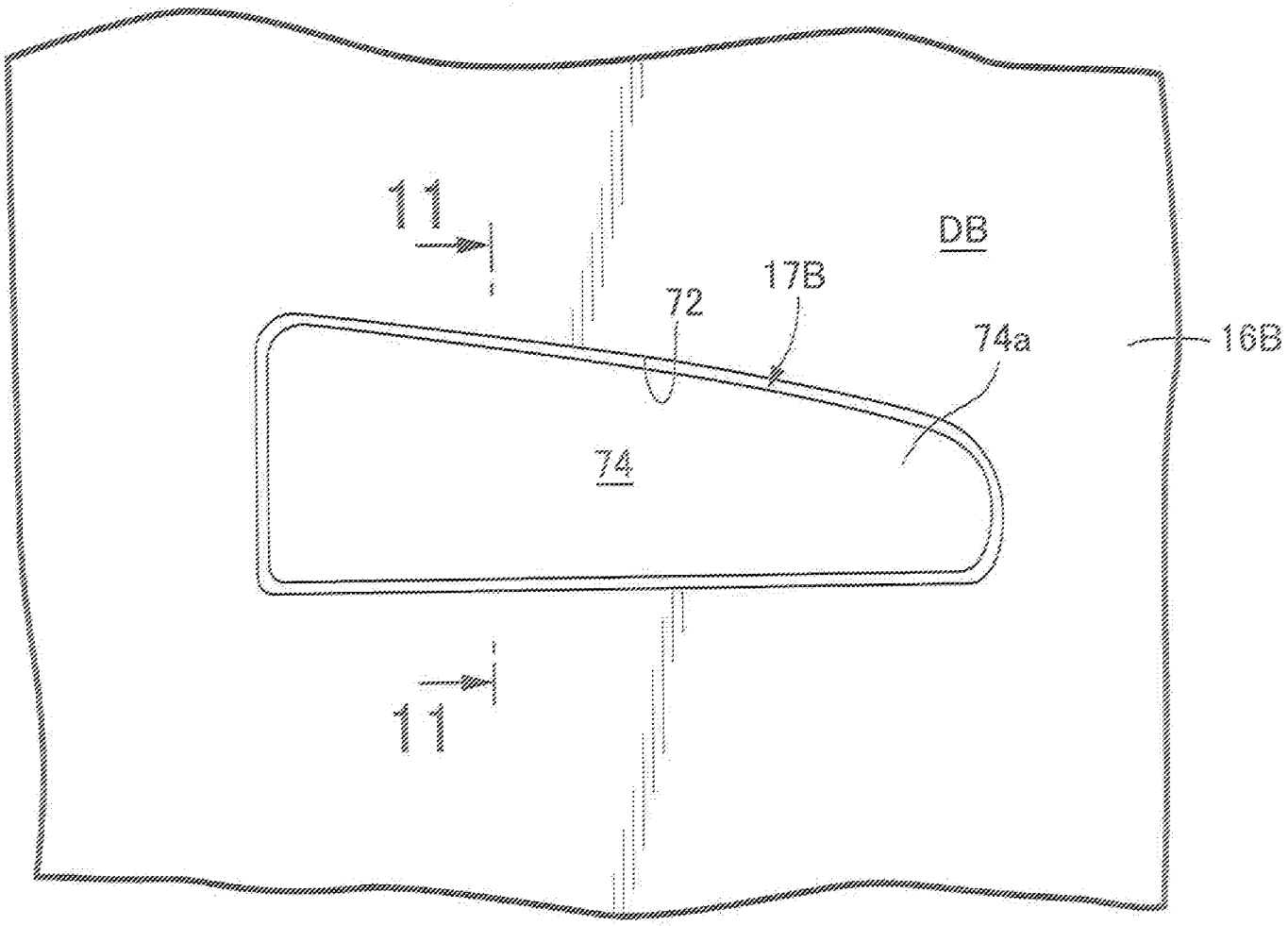
FIG. 10 is a side view showing part of a front side door of a second embodiment. (second embodiment)

First, in FIG. 10, an outer panel 16B of a front side door DB is provided with an opening 72, and latch release operation means 17B is mounted on the outer panel 16B at a position corresponding to the opening 72, the latch release operation means 17B being operable by means of a hand inserted into the opening 72 from the outside.

Figure 11:
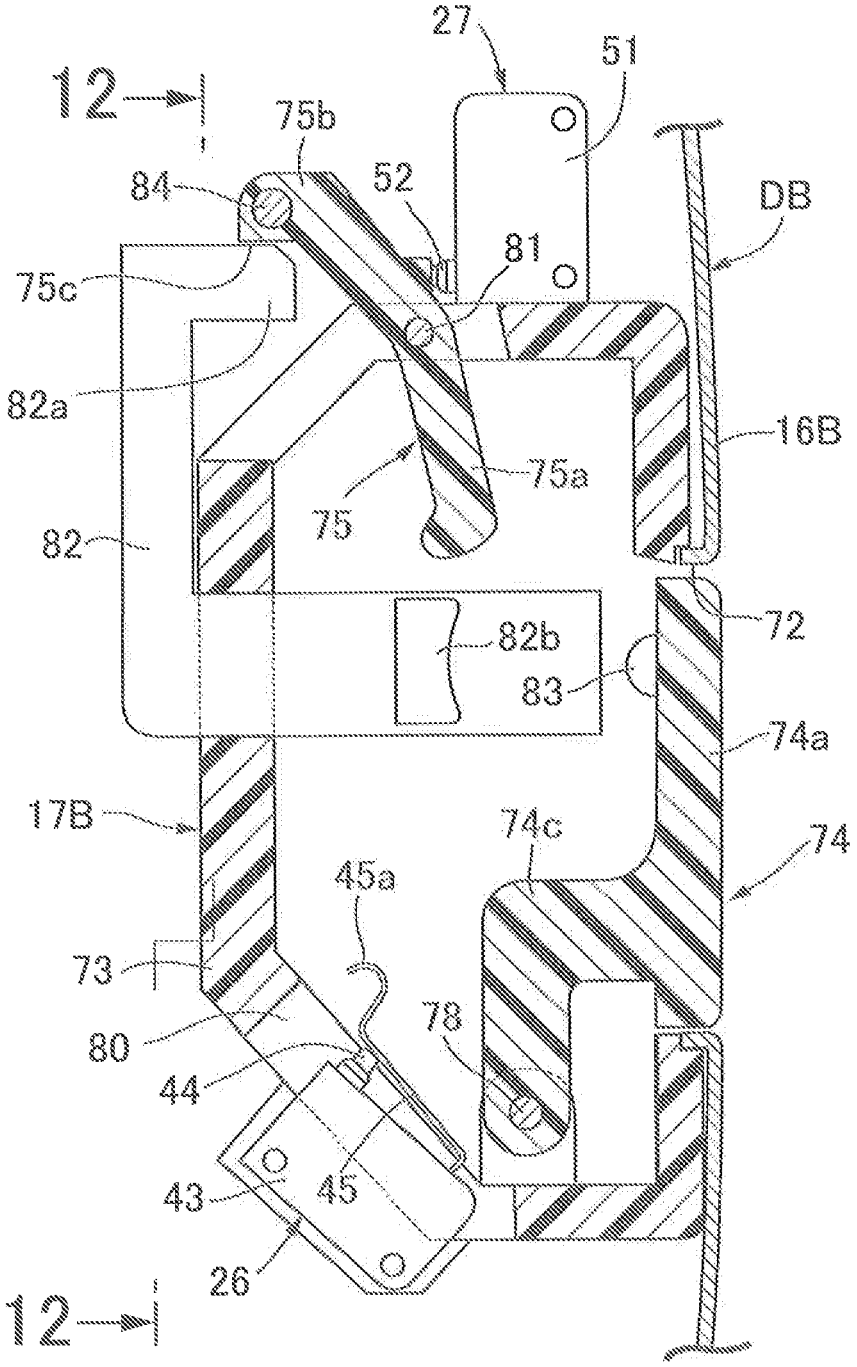
FIG. 11 is a sectional view along line 11-11 in FIG. 10 of a design cover in a non-operated state. (second embodiment)
Figure 12:
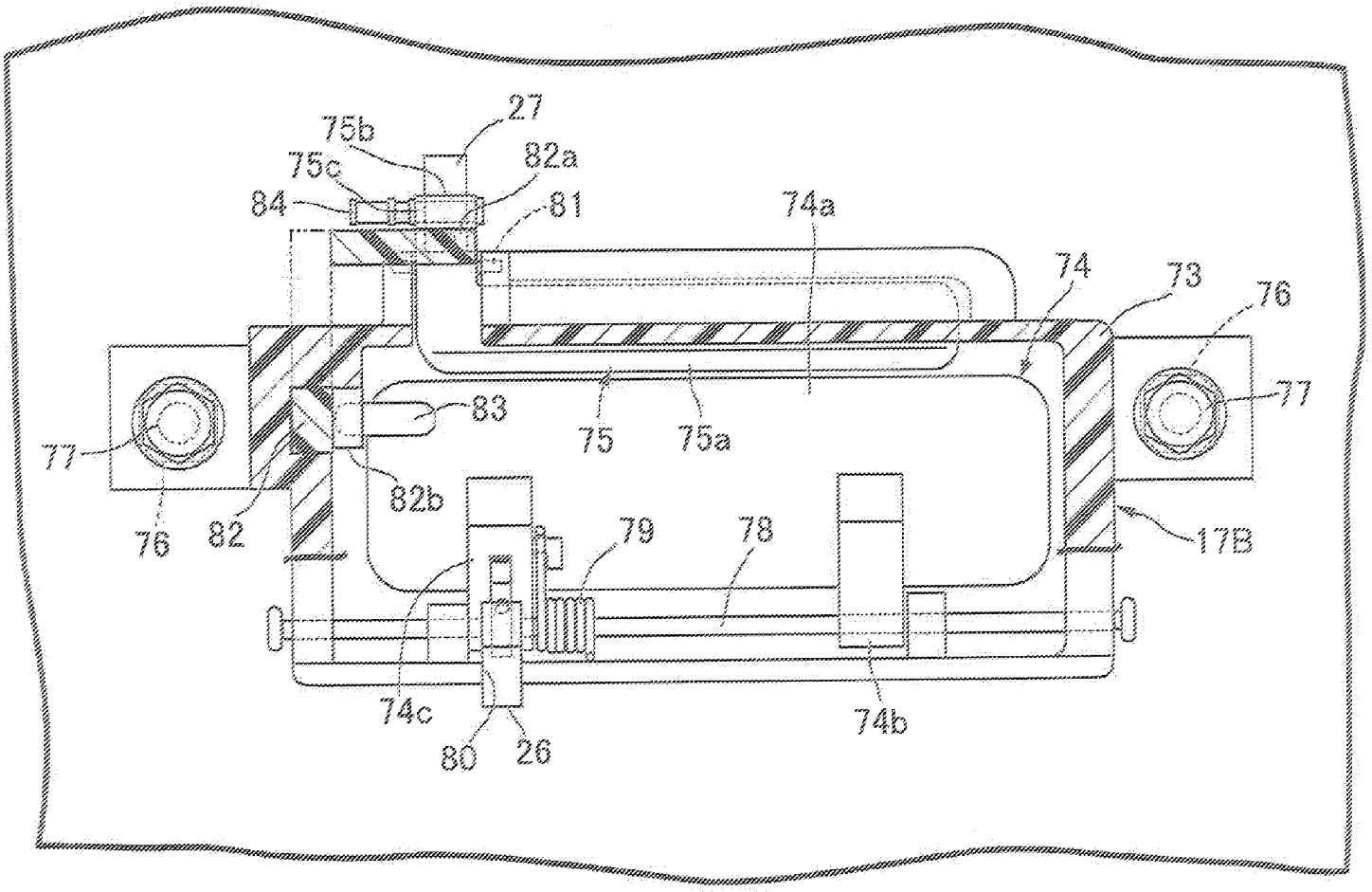
FIG. 12 is a sectional view along line 12-12 in FIG. 11. (second embodiment)

Referring in addition to FIG. 11 and FIG. 12, the latch release operation means 17B includes a case 73 that is mounted on an inner face of the outer panel 16B, a design cover 74 that is supported on the case 73 so that it can close at least part (the entirety in this embodiment) of the opening 72 and can be opened by a manual operation, an operating member 75 that is supported on the case 73 so that it can be manually operated in a state in which the design cover 74 is open, a first detection switch 26 that is mounted on the case 73 so that it detects displacement of the design cover 74 from a closed position toward an open position, and a second detection switch 27 that is mounted on the case 73 so that it detects that the operating member 75 has been operated.

Nuts 76 and 76 are secured by welding to the inner face of the outer panel 16B so as to correspond to a front part and a rear part of the case 73, and the case 73 is fixedly mounted on the inner face of the outer panel 16B by screwing into the nuts 76 and 76 bolts 77 and 77 inserted through the front part and the rear part of the case 73.

The design cover 74 integrally has a flat plate-shaped cover portion 74*a* that is formed into a shape corresponding to the opening 72 so that it can close the entirety of the opening 72, and a pair of leg portions 74*b* and 74*c* extending downwardly from a lower part of the cover portion 74*a*, lower parts of the two leg portions 74*b* and 74*c* being pivotably supported on a lower part of the interior of the case 73 via a support shaft 78 inserted through the leg portions 74*b* and 74*c*, and the design cover 74 being pivotable between a closed position shown in FIG. 11 and an open position in which the design cover 74 has pivoted in a counterclockwise direction from the state of FIG. 11.

A return spring 79, which is a torsion spring surrounding the support shaft 78, is provided between the design cover 74 and the case 73, and the design cover 74 is urged toward the closed position by means of the return spring 79.

The first detection switch 26 is mounted on a lower part of the case 73 at a position corresponding to the leg portion 74*c* of the design cover 74 so that the first detection switch 26 detects that the design cover 74 has pivoted from the closed position toward the open position.

A detector 44 and a plate spring 45 of the first detection switch 26 project into the case 73 through a slit 80 provided in a lower part of the case 73, and an intermediate part of the plate spring 45 where it is close to a contact portion 45*a* formed on the plate spring 45 makes contact with the detector 44. When the design cover 74 pivots from the closed position toward the open position and the leg portion 74*c* abuts against the contact portion 45*a* of the plate spring 45, the detector 44 is pushed in by the plate spring 45 to thereby turn the first detection switch 26 ON.

The first detection switch 26 detects that the design cover 74 has been pivoted in order to release a latched state of the front side door DB, but when the first detection switch 26 detects a displacement of the design cover 74 from the closed position toward the open position in a state in which a latch device 20 (ref. the first embodiment) is unlocked, a control unit 58 (ref. the first embodiment) to which a signal from the first detection switch 26 is inputted may operate an electric motor for lock/unlock switching 56 so that the latch device 20 is switched from an unlocked state to a locked state, and in this case the control unit 58 determines that a vehicle user has showed an intention to put the front side door DB in a locked state, by means of a signal inputted from the first detection switch 26 in response to the design cover 74 being pushed for a long time.

The operating member 75 has an operating portion 75*a* that extends in the fore-and-aft direction of the vehicle and is disposed on an upper part of the case 73 while enabling a vehicle user to put a hand thereon, and an arm portion 75*b* that extends upwardly from one end part along the fore-and-aft direction of the operating portion 75*a*, the arm portion 75*b* extending through the upper part of the case 73 and projecting upwardly, and an intermediate part of the arm portion 75*b* being pivotably supported on the upper part of the case 73 via a shaft 81.

Figure 13:
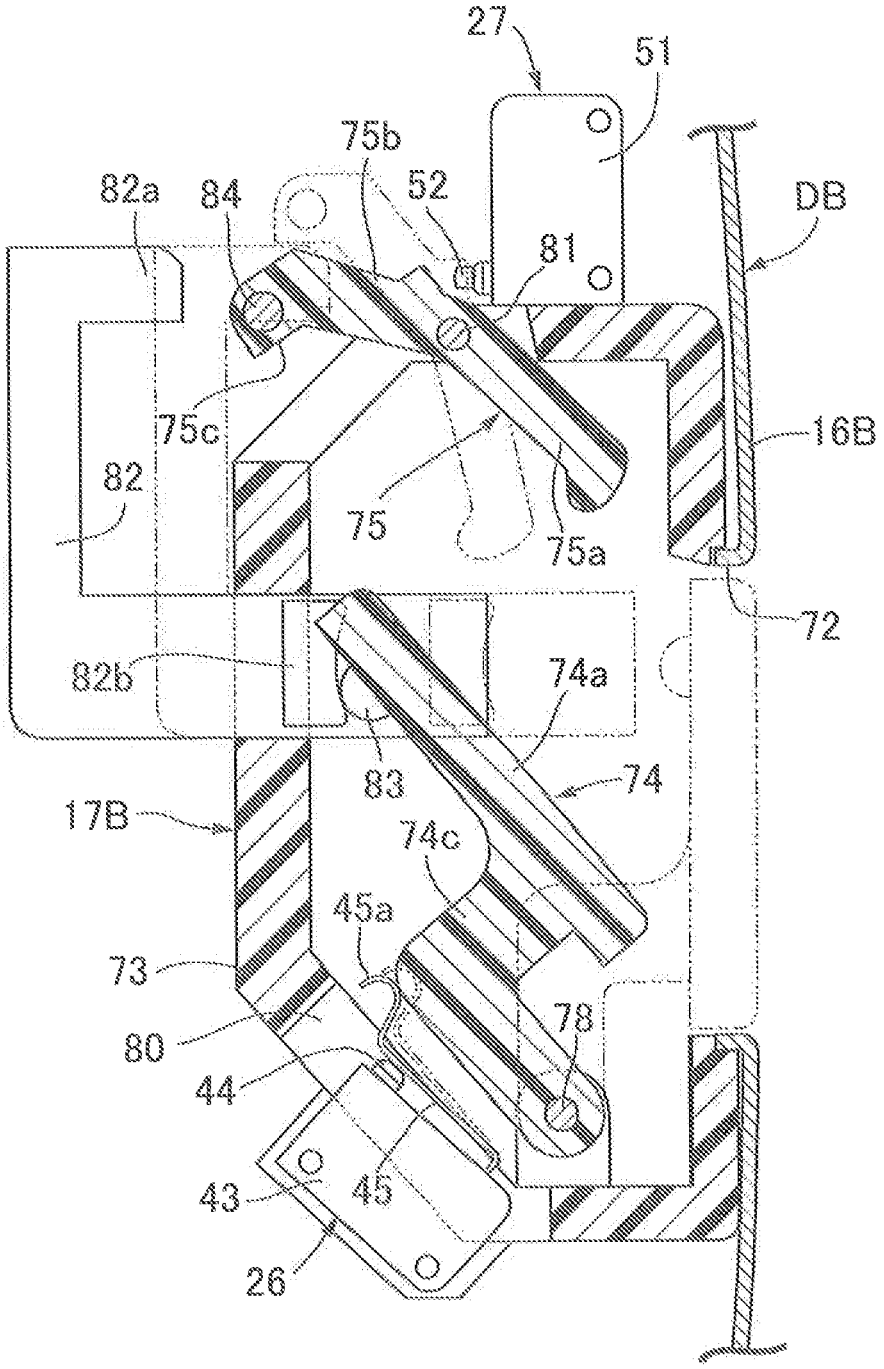
FIG. 13 is a sectional view, corresponding to FIG. 11, of the design cover and an operating member, both being in an operated state. (second embodiment)

The operating member 75 is pivoted from a non-operated position shown by FIG. 11 to an operated position shown by FIG. 13 by pulling the operating portion 75*a* with a hand in a state in which the design cover 74 has been pivoted to the open position, and the operating member 75 is pivotingly urged toward the non-operated position by resilient means, which is not illustrated.

Furthermore, the second detection switch 27 is mounted on the upper part of the case 73 so that it attains an ON state when a detector 52 is pushed by the arm portion 75*b* of the operating member 75 in a state in which the operating member 75 is in the non-operated position, the second detection switch 27 attaining an OFF state due to the force acting on the detector 52 from the arm portion 75*b* being released when the operating member 75 has moved slightly from the non-operated position toward the operated position, and this OFF state allows operation of the operating member 75 to be detected.

Supported on the case 73 so that it can slide in the vehicle width direction is a slide member 82 having in an upper end part a stopper 82*a* that can engage from below with an engagement portion 75*c* provided at the tip of the arm portion 75*b* provided integrally with the operating member 75. A pressure-receiving portion 82*b* is projectingly provided on the slide member 82, a pressing projection 83 provided on the cover portion 74*a* of the design cover 74 abutting against the pressure-receiving portion 82*b*.

In a state in which the operating member 75 is in the non-operated position as shown in FIG. 11, the slide member 82 is at a pivoting restricting position in which the stopper

82*a* is engaged with the engagement portion 75*c* of the operating member 75 from above to thus disable a pivoting operation of the operating member 75, the pressing projection 83 of the design cover 74 in the closed position is at a position separated from the pressure-receiving portion 82*b* of the slide member 82, and the slide member 82 is urged toward the pivoting restricting position by resilient means, which is not illustrated.

When the design cover 74 pivots to the open position as shown in FIG. 13, the pressing projection 83 of the design cover 74 abuts against the pressure-receiving portion 82*b* and pushes the slide member 82, the slide member 82 slides to a pivoting allowing position in which the stopper 82*a* has retracted sideways from the engagement portion 75*c*, and in this state the operating member 75 becomes pivotable.

Furthermore, a rod 84 is linked to the tip of the arm portion 75*b* of the operating member 75, the rod 84 forming part of transmission means for transmitting a mechanical operation force toward the latch device 20.

In accordance with this second embodiment, the same effects as those of the first embodiment can be exhibited and, furthermore, when the first detection switch 26 detects displacement of the design cover 74 from the closed position toward the open position when the latch device 20 (ref. the first embodiment) is in an unlocked state, the control unit 58 operates the electric motor for lock/unlock switching 56 so as to switch the latch device 20 from the unlocked state to the locked state, thereby making it unnecessary to employ the lock switch 19 of the first embodiment.

Third Embodiment

A third embodiment of the present invention is explained by reference to FIG. 14 and FIG. 15; parts corresponding to those of the first and second embodiments are illustrated with the same reference numerals and numbers, and detailed explanation thereof is omitted.

Figure 14:
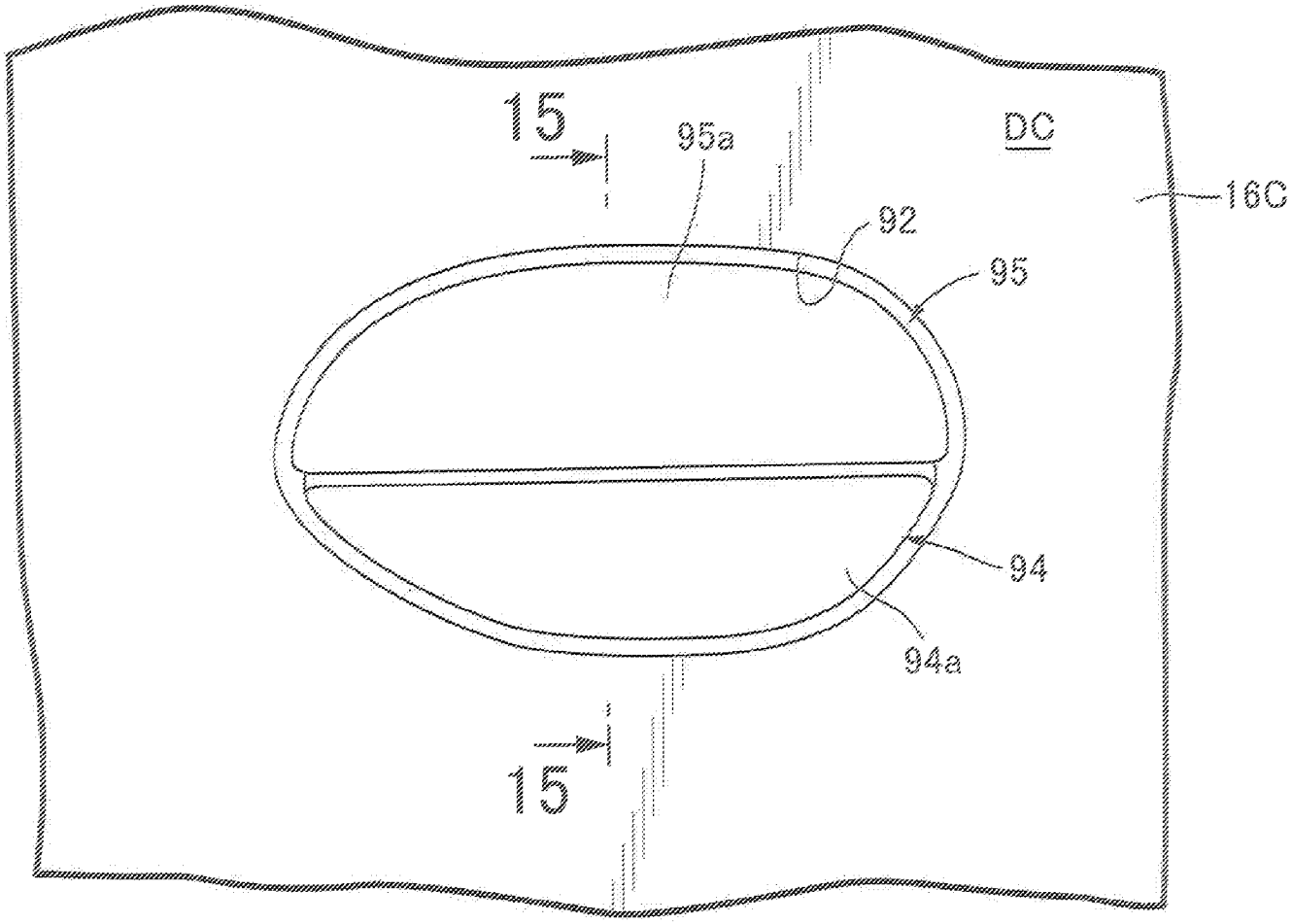
FIG. 14 is a side view showing a part of a front side door in a third embodiment. (third embodiment)

First, in FIG. 14, an outer panel 16C of a front side door DC is provided with an opening 92, and latch release operation means 17C is mounted on the outer panel 16C at a position corresponding to the opening 92, the latch release operation means 17C being operable by means of a hand inserted into the opening 92 from the outside.

Figure 15:
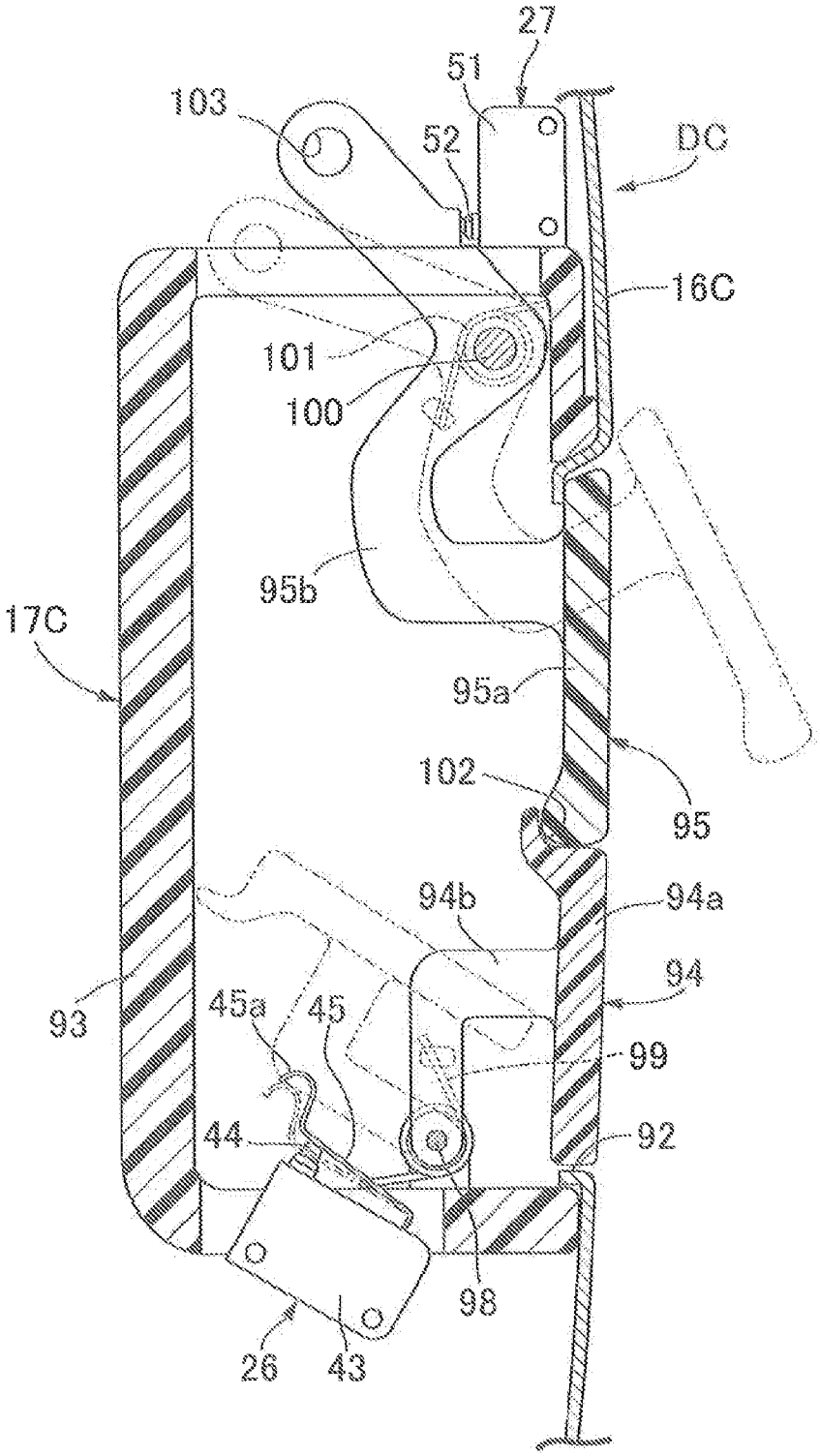
FIG. 15 is a sectional view along line 15-15 in FIG. 14. (third embodiment)

Referring in addition to FIG. 15, the latch release operation means 17C includes a case 93 that is mounted on an inner face of the outer panel 16C, a design cover 94 that is supported on the case 93 so that it can close at least part (a lower half in this embodiment) of the opening 92 and can be opened by a manual operation, an operating member 95 that is supported on the case 93 so that it can be manually operated in a state in which the design cover 94 is open, a first detection switch 26 that is mounted on the case 93 so that it detects displacement of the design cover 94 from a closed position toward an open position, and a second detection switch 27 that is mounted on the case 93 so that it detects that the operating member 95 has been operated.

The design cover 94 integrally has a flat plate-shaped cover portion 94*a* that is formed into a shape corresponding to a lower half of the opening 92 so that it can close the lower half of the opening 92, and a pair of leg portions 94*b* extending downwardly from a lower part of the cover portion 94*a*, lower parts of the two leg portions 94*b* being pivotably supported on a lower part of the interior of the case 93 via a support shaft 98 inserted through the leg portions 94*b*, and the design cover 94 being pivotable between a closed position shown by the solid line in FIG. 15 and an open position shown by the chain line in FIG. 15.

A return spring 99, which is a torsion spring surrounding the support shaft 98, is provided between the design cover 94 and the case 93, and the design cover 94 is urged toward the closed position by means of the return spring 99.

The first detection switch 26 is mounted on a lower part of the case 93 at a position corresponding to the leg portion 94*c* of the design cover 94 so that the first detection switch 26 detects that the design cover 94 has pivoted from the closed position toward the open position.

The first detection switch 26 detects that the design cover 94 has been pivoted in order to release a latched state of the front side door DC, but when the first detection switch 26 detects a displacement of the design cover 94 from the closed position toward the open position in a state in which a latch device 20 (ref. the first embodiment) is unlocked, a control unit 58 (ref. the first embodiment) to which a signal from the first detection switch 26 is inputted may operate an electric motor for lock/unlock switching 56 so that the latch device 20 is switched from an unlocked state to a locked state.

The operating member 95 has a flat plate-shaped operating portion 95*a* that extends in the fore-and-aft direction of the vehicle and is formed so as to correspond to the shape of the upper half of the opening 92 while enabling a vehicle user to put a hand thereon, and an arm portion 95*b* that extends upwardly from the operating portion 95*a*, the arm portion 95*b* extending through the upper part of the case 93 and projecting upwardly, and an intermediate part of the arm portion 95*b* being pivotably supported on the upper part of the case 93 via a shaft 100.

The operating member 95 is pivoted from a non-operated position shown by the solid line in FIG. 15 to an operated position shown by the chain line in FIG. 15 by pulling the operating portion 95*a* with a hand in a state in which the design cover 94 has been pivoted to the open position, and the operating member 95 is pivotingly urged toward the non-operated position by a torsion spring 101 provided between the operating member 95 and the case 93 while surrounding the shaft 100.

Moreover, a recess part 102 is provided in an upper part of the design cover 94, the recess part 102 housing a lower end part of the operating portion 95*a* of the operating member 95 in the non-operated position at the closed position, and when the design cover 94 is not manually operated toward the open position the operating portion 95*a* of the operating member 95 cannot be pivoted toward the operated position.

Furthermore, the second detection switch 27 is mounted on the upper part of the case 93 so that it attains an ON state when a detector 52 is pushed by the arm portion 95*b* of the operating member 95 in a state in which the operating member 95 is in the non-operated position, the second detection switch 27 attaining an OFF state due to the force acting on the detector 52 from the arm portion 95*b* being released when the operating member 95 has moved slightly from the non-operated position toward the operated position, and this OFF state allows operation of the operating member 95 to be detected.

Furthermore, a linking hole 103 is provided at the tip of the arm portion 95*b* of the operating member 95, a rod, etc. for transmitting a mechanical operation force toward the latch device 20 being linked to the linking hole 103.

In accordance with this third embodiment, the same effects as those of the second embodiment can be exhibited.

Embodiments of the present invention are explained above, but the present invention is not limited to the embodiments and may be modified in a variety of ways as long as the modifications do not depart from the spirit and scope thereof.

The invention claimed is:

1. A vehicle door open/close operation apparatus comprising a design cover that can be opened by a manual operation and that can close at least part of an opening provided in a door, an operating member that is movable separately from the design cover and can be manually operated at a position inside the door in a state in which the design cover is open, a latch device that can switch between an unlocked state in which latch release of the door is enabled and a locked state in which latch release of the door is disabled and that has an electric actuator for latch release for releasing the latched state of the door in response to an operation in the unlocked state, and a control unit that can carry out user authentication for confirming whether or not a person operating the operating member is a legitimate vehicle user and that controls operation of the electric actuator for latch release so as to operate the electric actuator for latch release so as to release the latched state in response to operation of the operating member in a state in which being a legitimate vehicle user has been authenticated, wherein the apparatus comprises a detection switch for detecting displacement of the design cover from a closed position toward an open position, and the control unit carries out the user authentication in response to detection of displacement of the design cover by the detection switch.

2. The vehicle door open/close operation apparatus according to claim 1, wherein the latch device comprises an electric actuator for lock/unlock switching that can switch between the unlocked state and the locked state, and the control unit controlling operation of the electric actuator for lock/unlock switching operates the electric actuator for lock/unlock switching so as to switch the latch device from the locked state to the unlocked state in response to the detection switch detecting displacement of the design cover from the closed position toward the open position.

3. The vehicle door open/close operation apparatus according to claim 2, wherein the control unit operates the electric actuator for lock/unlock switching so as to switch the latch device from the unlocked state to the locked state in response to the detection switch detecting a displacement of the design cover from the closed position toward the open position in a state in which the latch device is unlocked.

* * * * *